US010876461B2

(12) United States Patent
Smith et al.

(10) Patent No.: US 10,876,461 B2
(45) Date of Patent: Dec. 29, 2020

(54) EXHAUST COUPLING SYSTEM AND METHOD

(71) Applicant: TRU-FLEX, LLC, West Lebanon, IN (US)

(72) Inventors: Michael L. Smith, Nashville, IN (US); Scott R. Swank, Williamsport, IN (US)

(73) Assignee: Tru-Flex, LLC, West Lebanon, IN (US)

( * ) Notice: Subject to any disclaimer, the term of this patent is extended or adjusted under 35 U.S.C. 154(b) by 390 days.

(21) Appl. No.: 16/009,530

(22) Filed: Jun. 15, 2018

(65) Prior Publication Data

US 2018/0363536 A1 Dec. 20, 2018

Related U.S. Application Data

(60) Provisional application No. 62/519,954, filed on Jun. 15, 2017.

(51) Int. Cl.

| | |
|---|---|
| ***F16L 27/11*** | (2006.01) |
| ***F01N 13/18*** | (2010.01) |
| ***F01N 13/16*** | (2010.01) |

(52) U.S. Cl.

CPC ..... *F01N 13/1816* (2013.01); *F01N 13/16* (2013.01); *F01N 13/1844* (2013.01); *F01N 2260/26* (2013.01); *F01N 2470/12* (2013.01); *F01N 2470/24* (2013.01); *F01N 2530/18* (2013.01); *F01N 2530/22* (2013.01)

(58) Field of Classification Search

CPC ... F16L 25/0036; F16L 27/10; F16L 27/1004; F16L 27/107; F16L 27/11; F01N 13/1816; F01N 13/16; F01N 13/1844

USPC ..... 285/49, 48, 53, 226, 227

See application file for complete search history.

(56) References Cited

U.S. PATENT DOCUMENTS

| | | | | |
|---|---|---|---|---|
| 3,747,367 | A * | 7/1973 | Muller | F16D 3/74 464/79 |
| 4,966,202 | A * | 10/1990 | Bryan | F16L 11/12 138/103 |
| 5,660,899 | A * | 8/1997 | Rockney | F16L 11/118 138/122 |
| 5,769,463 | A | 6/1998 | Winfield | |
| 5,791,696 | A * | 8/1998 | Miyajima | F16L 11/11 285/222.1 |
| 5,829,483 | A * | 11/1998 | Tukahara | F16L 9/18 138/109 |

(Continued)

FOREIGN PATENT DOCUMENTS

| | | | |
|---|---|---|---|
| GB | 2416378 | A | 1/2006 |
| WO | 2015152791 | A1 | 10/2015 |

OTHER PUBLICATIONS

European Search Report, European Application No. 18177870.5-1004, dated Sep. 21, 2018, 8 pages.

*Primary Examiner* — Aaron M Dunwoody

(74) *Attorney, Agent, or Firm* — Barnes & Thornburg LLP

(57) ABSTRACT

A system and method including a non-metallic shell to prevent debris from contacting a component of an exhaust system is disclosed. The shell may be formed from silicone. The shell may also form part of an assembly including a metallic corrugated body, which may be positioned between two pipe sections of the exhaust system. The shell may be separate from an exhaust coupler and be secured separately to the two pipe sections connected to the exhaust coupler.

17 Claims, 12 Drawing Sheets

(56) References Cited

U.S. PATENT DOCUMENTS

| | | | | |
|---|---|---|---|---|
| 5,983,950 | A * | 11/1999 | Aoki | F16L 25/0036 138/109 |
| 6,354,332 | B1 * | 3/2002 | Burkhardt | F16L 11/15 138/109 |
| 6,607,218 | B2 * | 8/2003 | Sakazaki | F16L 11/04 285/222.1 |
| 6,902,203 | B2 | 6/2005 | Kang | |
| 9,157,559 | B2 | 10/2015 | Stalcup, II et al. | |
| 9,338,933 | B2 * | 5/2016 | Cataldo | H01B 1/023 |
| 2005/0167192 | A1 | 8/2005 | Simon | |
| 2012/0056414 | A1 * | 3/2012 | Thomas | F01N 13/148 285/49 |
| 2012/0279606 | A1 * | 11/2012 | Teso, Jr. | F16L 59/22 138/140 |
| 2013/0015652 | A1 * | 1/2013 | Thomas | F16L 59/21 285/47 |

* cited by examiner

EXHAUST COUPLING SYSTEM AND METHOD

This application claims priority to U.S. Provisional Patent Application No. 62/519,954, which was filed on Jun. 15, 2017 and is expressly incorporated herein by reference.

TECHNICAL FIELD

The present disclosure relates generally to coupling systems for pipes or tubes, and, more specifically, to coupling systems for use in exhaust systems of automobiles, trucks, farm equipment, construction equipment, or other equipment.

BACKGROUND

Exhaust systems for automobiles, trucks, farm equipment, construction equipment, or other equipment typically include one or more exhaust pipes that direct exhaust gas emissions from the engine to an outlet. Such exhaust systems also include one or more couplers to absorb vibrations in the exhaust piping, address thermal effects such as expansion or contraction, or compensate for misalignments in the exhaust piping.

Many exhaust systems are exposed to materials such as field debris, dried leaves, sand, gravel, and other objects, which may come into contact with various components of the exhaust system. Some systems include braid covers to protect components of the exhaust couplers from contact with such objects.

Exemplary couplers for use in exhaust systems is shown and described in U.S. Pat. Nos. 9,157,559; 6,902,203; and 5,769,463.

SUMMARY

A system and method including a flexible, non-metallic shell to prevent debris from contacting a component of an exhaust system is disclosed. In some embodiments, the shell may be formed from silicone. The shell may form part of an exhaust coupler assembly that may be positioned between two pipe sections of the exhaust system. It should also be appreciated that the silicone shell may be separate from the exhaust coupler assembly and be secured separately to the two pipe sections.

According to one aspect of the disclosure the system comprises a metallic body including a first longitudinal end, a second longitudinal end, and a first plurality of corrugations between the first longitudinal end and the second longitudinal end. The shell is spaced apart from, and arranged concentrically with, the metallic body. The system also comprises a first ring secured to the first longitudinal end of the metallic body, and a second ring secured to the second longitudinal end of the metallic body. The first ring is configured to be coupled to a first pipe section of an exhaust system, and the second ring is configured to be coupled to a second pipe section of the exhaust system.

The shell, which is illustratively formed from silicone, includes a second plurality of corrugations and extends a first distance between a first shell end and a second shell end. The first plurality of corrugations of the metallic body extend a second distance along the metallic body. The second distance is less than the first distance such that the silicone shell prevents debris from contacting the first plurality of corrugations.

In some embodiments, the first shell end of the silicone shell may be secured to the first ring. Additionally, in some embodiments, the second shell end of the silicone shell may be secured to the second ring.

In some embodiments, the system may also comprise a first mounting flange secured to the first pipe section of the exhaust system. The first shell end of the silicone shell may be coupled to the first mounting flange. Additionally, in some embodiments, the system may further comprise a second mounting flange secured to the second pipe section of the exhaust system. The second shell end of the silicone shell may be coupled to the second mounting flange.

In some embodiments, the system may further comprise an insulation sleeve positioned between the metallic body and the silicone shell. In some embodiments, the system may further comprise an inner sleeve positioned in a central passageway extending through the first longitudinal end and the second longitudinal end of the metallic body.

Additionally, in some embodiments, the inner sleeve may include a first end positioned in the first ring and a second end positioned in the second ring.

In some embodiments, the inner sleeve may be a first inner sleeve, and the system may comprise a second inner sleeve including a central section that is spaced apart from, and arranged concentrically with, a central section of the first inner sleeve. Each sleeve may be formed from a flexible or semi-flexible metallic material such as, for example, a spirally wound strip with edges of adjacent windings that are interlocked.

In some embodiments, the system may further comprise a plurality of mesh rings positioned between the first inner sleeve and the plurality of corrugations of the metallic body. Additionally, in some embodiments, the system may further comprise a number of spacer rings positioned between the first inner sleeve and the second inner sleeve. In some embodiments, the first ring may be one of the spacer rings; additionally, in some embodiments, the second ring may be one of the spacer rings.

In some embodiments, the second inner sleeve may have a first end positioned in the first ring and a second end positioned in the second ring.

In some embodiments, the system may comprise a first encapsulation layer extending over the first shell end and configured to extend over a portion of the first pipe section, and a second encapsulation layer extending over the second shell end and configured to extend over a portion of the second pipe section.

According to another aspect, an exhaust coupler assembly comprises an inner sleeve extending along a longitudinal axis. The inner sleeve including a first end configured to be coupled to a first pipe section of an exhaust system and a second end configured to be coupled to a second pipe section of the exhaust system. The assembly also includes a metallic body extending along the longitudinal axis. The metallic body includes a plurality of corrugations spaced apart from, and arranged concentrically with, the inner sleeve.

A first ring is positioned over the first end of the inner sleeve, and the first ring includes a first mounting flange spaced apart from, and arranged concentrically with, a first corrugation of the plurality of corrugations of the metallic body. A second ring is positioned over the second end of the inner sleeve, and the second ring includes a second mounting flange spaced apart from, and arranged concentrically with, a second corrugation of the plurality of corrugations of the metallic body.

The non-metallic shell is spaced apart from, and arranged concentrically with, the metallic body. The non-metallic shell has a first shell end secured to the first mounting flange and a second shell end secured to the second mounting flange. The non-metallic shell extends a first distance from the first shell end to the second shell end, and the plurality of corrugations extend a second distance along the metallic body. The second distance is less than the first distance such that the non-metallic shell prevents debris from contacting the plurality of corrugations.

In some embodiments, the non-metallic shell may include a second plurality of corrugations between the first shell end and the second shell end. Additionally, in some embodiments, the system may further comprise an insulation sleeve positioned between the metallic body and the non-metallic shell. The insulation sleeve may have a first sleeve end arranged concentrically with the first mounting flange and may have a second sleeve end arranged concentrically with the second mounting flange.

In some embodiments, the inner sleeve may be a first inner sleeve, and the exhaust coupler assembly may further comprise a second inner sleeve positioned between, and arranged concentrically with, the plurality of corrugations of the metallic body and the first inner sleeve.

Additionally, in some embodiments, the assembly may further comprise a plurality of spacer rings positioned between the first inner sleeve, the second inner sleeve, and the plurality of corrugations of the metallic body.

In some embodiments, the assembly may comprise a first encapsulation layer extending over the first shell end, and a second encapsulation layer extending over the second shell end.

According to another aspect of the disclosure, an exhaust system comprises a first pipe section including a first end, a second pipe section including a second end, a first mounting flange coupled to the first pipe section, and a second mounting flange coupled to the second pipe section. The system also includes a metallic body having a first longitudinal end coupled to the first end of the first pipe section, a second longitudinal end coupled to the second end of the second pipe section, and a plurality of corrugations between the first longitudinal end and the second longitudinal end. The non-metallic shell, which may be formed from silicone, is spaced apart from and extending over the metallic body. The non-metallic shell includes a first shell end that extends over the first end of the first pipe section and a second shell end that extends over the second end of the second pipe section, the first shell end being secured to the first mounting flange and the second shell end being secured to the second mounting flange.

In some embodiments, the system further comprises an inner sleeve positioned in a central passageway extending through the first longitudinal end and the second longitudinal end of the metallic body.

In some embodiments, the first ring of the exhaust coupler assembly may include a third mounting flange positioned radially inward of the first mounting flange. The third mounting flange may be configured to receive an end of an insulation sleeve extending from the first pipe section. Additionally, in some embodiments, the second ring of the exhaust coupler assembly may include a fourth mounting flange positioned radially inward of the second mounting flange. The fourth mounting flange may be configured to receive an end of an insulation sleeve extending from the second pipe section.

In some embodiments, the exhaust system may comprise a first insulation sleeve extending between the first pipe section and the first mounting flange. The first insulation sleeve may be positioned radially inward of the non-metallic shell. Additionally, in some embodiments, the exhaust system may comprise a second insulation sleeve extending between the second pipe section and the second mounting flange. The second insulation sleeve may be positioned radially inward of the non-metallic shell.

BRIEF DESCRIPTION OF THE DRAWINGS

The detailed description particularly refers to the following figures, in which.

DETAILED DESCRIPTION OF THE DRAWINGS

Figure 1:
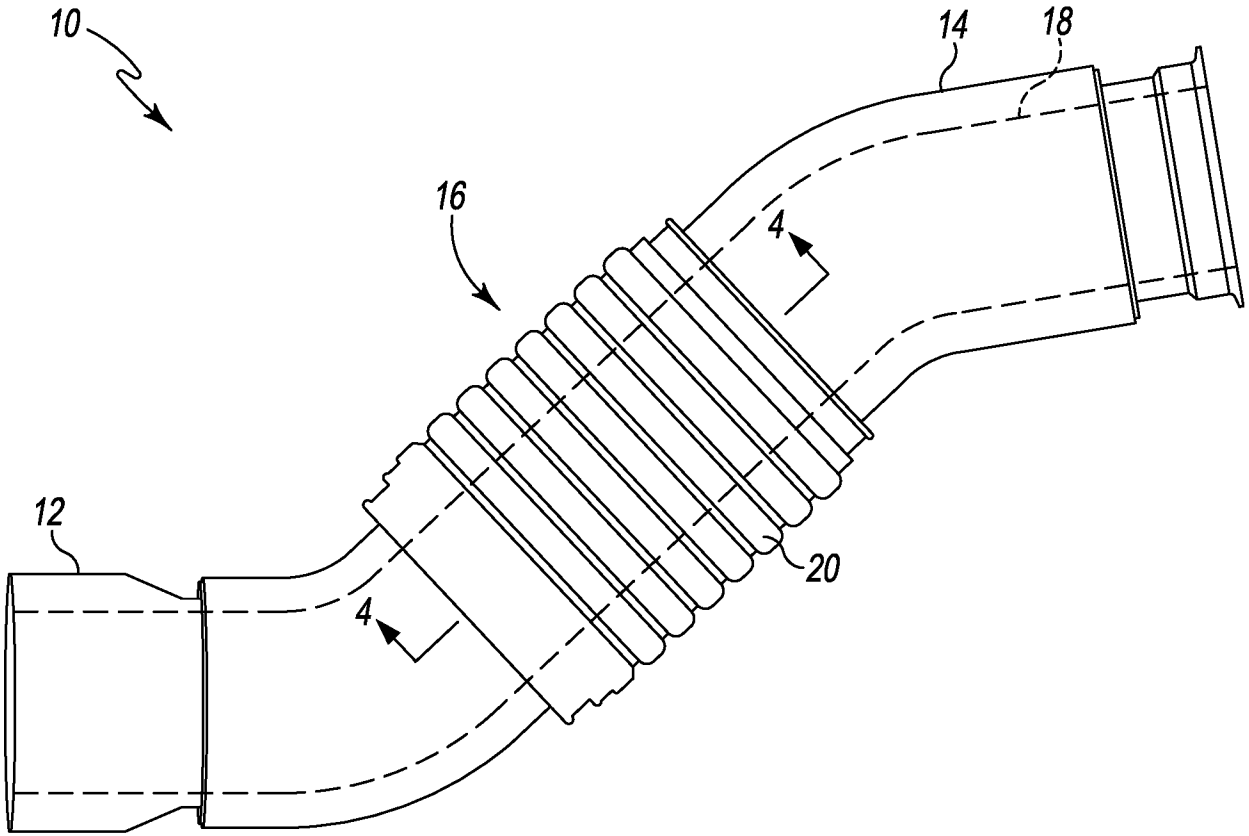
FIG. 1 is a plan view of an exhaust system.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring now to FIG. 1, a portion of an exhaust system 10 for an automobile, truck, farm equipment, construction equipment, or other motorized equipment is shown. The exhaust system 10 includes a pipe section 12 and a pipe section 14 that are connected by an exhaust coupler assembly 16. The sections 12, 14 and the coupler assembly 16 cooperate to define a passageway 18 through which exhaust gases flow.

As shown in FIG. 1, the coupler assembly 16 includes an outer shell 20 that covers the internal components of the coupler assembly 16 to prevent contact between environmental debris, such as, for example, seeds, sand, dried leaves, gravel, or other objects, and the internal components of the coupler assembly. In the illustrative embodiment, the shell 20 is formed of silicone and has a relatively low skin temperature (less than 300 degrees Fahrenheit) relative to the exhaust gas temperature, which, in some cases, may exceed 900 degrees Fahrenheit. In one embodiment, the shell 20 is formed from a polyester or nomex scrim cloth that is impregnated with silicone, which is then processed into the shape of the shell 20. It should be appreciated that in other embodiments the shell may be formed from other flexible, non-metallic materials that provide a relatively low skin temperature.

Figure 2:
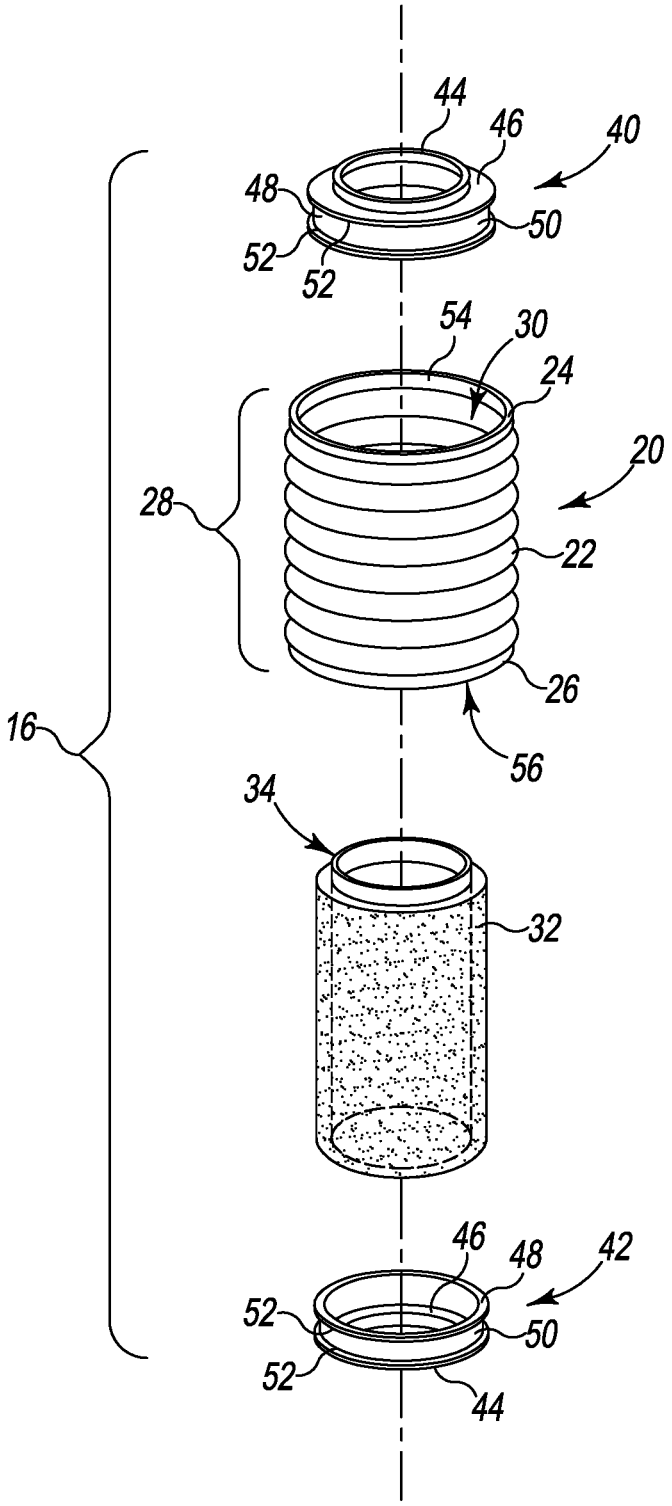
FIG. 2 is an exploded perspective view of an exhaust coupler assembly of the system of FIG. 1.

Referring now to FIG. 2, the outer shell 20 includes a substantially cylindrical body 22 that extends from a longitudinal end 24 to an opposite longitudinal end 26. The outer shell 20 includes a plurality of corrugations 28 defined in the outer surface of the body 22. In the illustrative embodiment, the corrugations 28 extend the length of the cylindrical body 22. In other embodiments, the shell 20 may include fewer corrugations positioned over a smaller portion of the cylindrical body. In still other embodiments, the corrugations may be larger or smaller than the corrugations 28 shown in FIG. 2.

The outer shell 20 also includes a central passageway 30 that extends through the ends 24, 26 of the body 22. The central passageway 30 is sized to receive an insulation sleeve 32 and a number of other internal components 34 of the assembly 16, which are described in greater detail below in reference to FIG. 3.

As shown in FIG. 2, the assembly 16 also includes a pair of mounting rings 40, 42, which are secured at the ends 24, 26, respectively, of the shell body 22. The mounting ring 40 includes a central sleeve 44 and an annular wall 46 extending outwardly from one end of the sleeve 44. A mounting flange 48 extends away from the outer edge of the annular wall 46. In the illustrative embodiment, the mounting flange 48 includes a groove 50 defined between a pair of inner walls 52. The groove 50 is sized to receive a tension strap clamp (not shown) to secure the ring 40 to the outer shell 20. One example of the tension strap clamp is the Panduit Pan-Steel clamp, which is commercially available from Panduit Corporation. In other embodiments, other fasteners may be used to secure the ring to the shell. In still other embodiments, one of the corrugations (i.e., corrugation 54) of the outer shell 20 may be received in each groove to secure the shell to the mounting ring.

Figure 4:
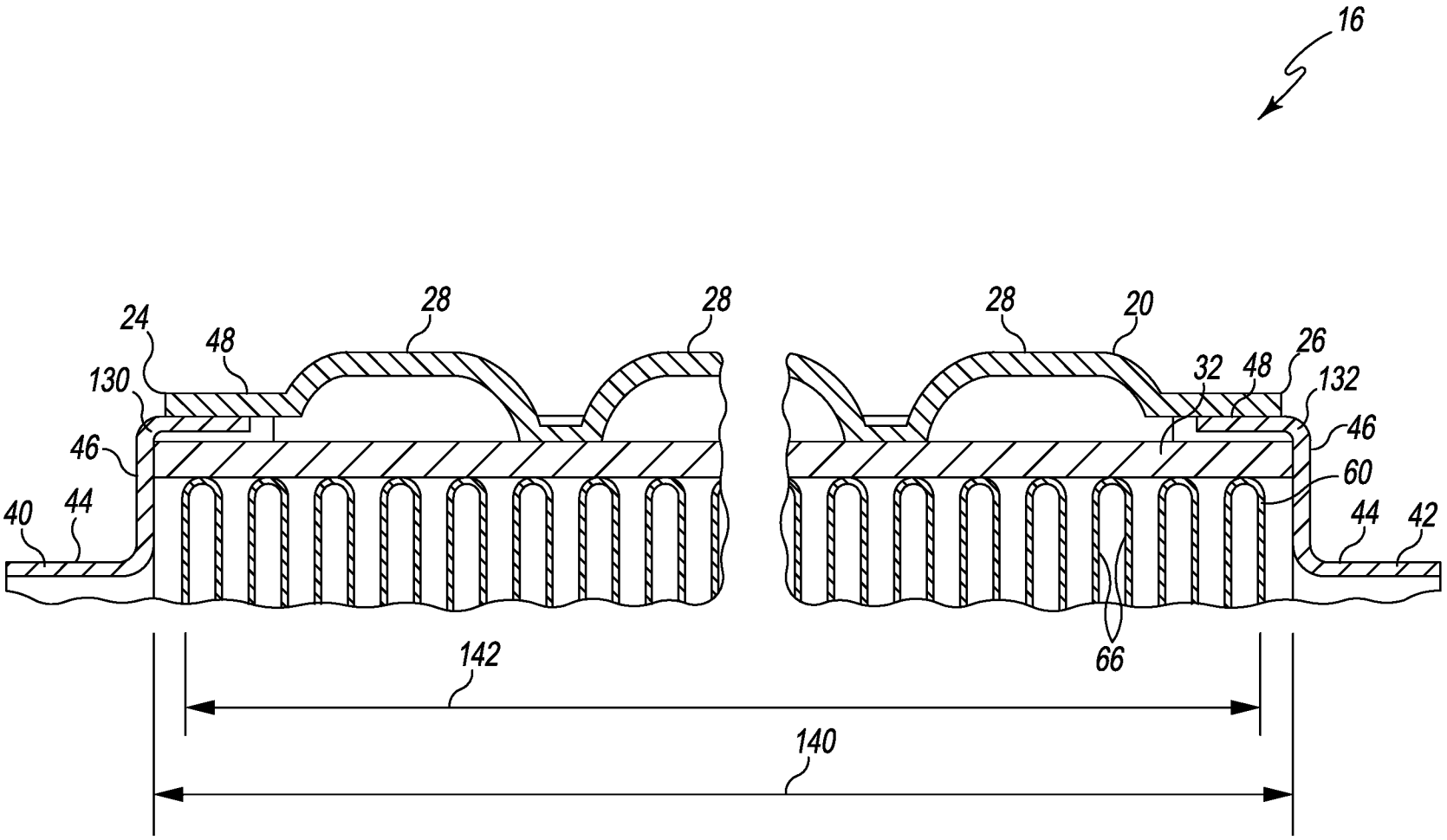
FIG. 4 is a partial cross-sectional elevation view of the exhaust coupler assembly taken along the line 4-4 in FIG. 1.

The mounting ring 42, like the mounting ring 40, includes a central sleeve 44, an annular wall 46 extending outwardly from one end of the sleeve 44, and a mounting flange 48 that extends away from the outer edge of the annular wall 46. The groove 50 is sized to receive a tension strap clamp (not shown) to secure the ring 42 to the outer shell 20. In other embodiments, other fasteners may be used to secure the ring to the shell. Each of the rings 40, 42 is formed from a metallic material such as, for example, stainless steel. In the illustrative embodiment, the rings 40, 42 are spot welded to a liner assembly 70 of the exhaust coupler assembly 16. As shown in FIG. 4, the ends 24, 26 of the shell 20 are positioned over the mounting flanges 48 of the rings 40, 42, respectively. The strap clamps may be positioned over the ends 24, 26 and the flanges 48 to secure the shell 20 to the rings 40, 42.

As described above, the assembly 16 includes an insulation sleeve 32 that is positioned between the outer shell 20 and other internal components 34 of the assembly 16. In the illustrative embodiment, the sleeve 32 is formed from silica fiber insulation. It should be appreciated that in other embodiments the sleeve 32 may be constructed from any material that is effective to attenuate noise, resist heat transmission, and/or dampen vibration. It should also be appreciated that in other embodiments the sleeve 32 may be omitted from the assembly 16.

Figure 3:
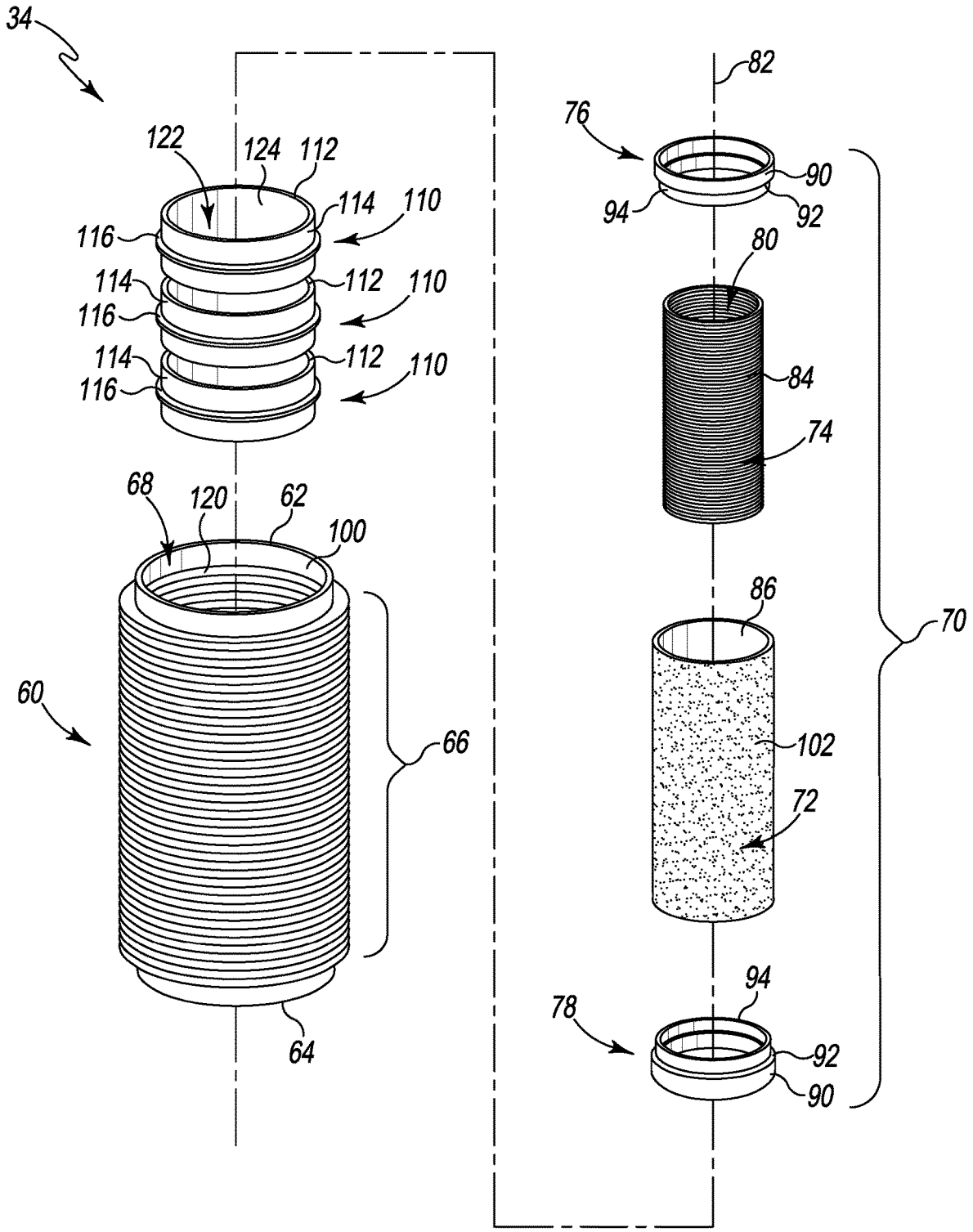
FIG. 3 is an exploded perspective view of components of the exhaust coupler assembly of FIG. 2.

Referring now to FIG. 3, the other internal components 34 of the assembly 16 are shown. The components 34 include a metallic body 60 that extends from a longitudinal end 62 to an opposite longitudinal end 64. The metallic body 60 includes a plurality of corrugations 66 positioned between the ends 62, 64. The metallic body 60 also includes a central passageway 68 that extends through the ends 62, 64 of the body 60. The metallic body 60 may be formed of any suitable metallic material including, for example, stainless steel.

The assembly 16 also includes a liner assembly 70 sized to be positioned in the central passageway 68 of the metallic body 60. In the illustrative embodiment, the liner assembly 70 includes an outer sleeve 72 that is coupled to an inner sleeve 74 via a pair of end rings 76, 78. It should be appreciated that in other embodiments the liner assembly 70 may include only a single sleeve. It should also be appreciated that in other embodiments the end rings may be omitted.

The outer sleeve 72 is formed of a spirally wound metallic strip with edges of adjacent windings that are interlocked. The inner sleeve 74 is also formed of a spirally wound metallic strip with edges of adjacent windings that are interlocked. An example of a spirally wound metallic strip with interlocked edges is shown and described in U.S. Pat. No. 7,066,495, which is incorporated by reference herein.

The inner sleeve 74 also includes a cylindrical bore 80 that defines a section of the passageway 18 through which the exhaust gases flow. In illustrative embodiment, the inner sleeve 74 (and the other components of the assembly 16) is positioned along a longitudinal axis 82. The sleeve 74 is illustratively arranged concentrically with the outer sleeve 72. The inner sleeve 74 has an outer surface 84 that is spaced apart from the inner surface 86 of the outer sleeve 72.

The end ring 76 includes an outer section 90 and an annular wall 92 that extends inwardly from the outer section 90. A central section 94 extends away from an inner edge of the annular wall 92. In the illustrative embodiment, one end of the inner sleeve 74 is secured to the central section 94 of the end ring 76, and one end of the outer sleeve 72 is secured to the outer surface of the outer section 90 to couple the sleeves 72, 74 together.

The end ring 78, like the end ring 76, includes an outer section 90 and an annular wall 92 that extends inwardly from the outer section 90. A central section 94 extends away from an inner edge of the annular wall 92. One end of the inner sleeve 74 is secured to the central section 94 of the end ring 78, and one end of the outer sleeve 72 is secured to the outer surface of the outer section 90 to couple the sleeves 72, 74 together. In the illustrative embodiment, the difference in the diameters of the central section 94 and the outer section 90 of the end ring 76, 78 defines the amount that the inner sleeve 74 is spaced apart from the outer sleeve 72. Each of the rings 76, 78 is formed from a metallic material such as, for example, stainless steel.

The corrugated body 60 is arranged concentrically with the sleeve 72, 74. The body 60 has an inner surface 100 that is spaced apart from the outer surface 102 of the outer sleeve 72. In the illustrative embodiment, the assembly 16 also includes a plurality of spacer rings 110 that are positioned along the longitudinal axis 82. Each ring 110 is formed from a metallic mesh material such as for example, stainless steel. In other embodiments, the rings 110 may be formed from copper, brass, or other metallic alloys. It should also be appreciated that in other embodiments the mesh rings may be omitted.

Each ring 110 includes a bushing 112 that has a substantially cylindrical outer surface 114. The ring 110 also includes an annular rib or tab 116 that extends outwardly from the outer surface 114. Each tab 116 is sized to be received in one of the slots 120 formed by the corrugations 66 in the inner surface 100 of the body 60. Each bushing 112 also has a central bore 122 that is sized to receive the outer sleeve 72.

The central bore 122 of each bushing 112 is defined by an inner surface 124 that is spaced apart from the outer surface 114 of the bushing 112. In illustrative embodiment, the thickness of the bushing 112 between the surfaces 114, 124 defines the amount that the corrugated body 60 is spaced apart from the outer sleeve 72 of the liner assembly 70.

Referring now to FIG. 4, the outer shell 20 is arranged concentrically with the metallic body 60. As described above, the insulation sleeve 32 is wrapped around the corrugations 66 of the metallic body 60 and is positioned between the metallic body 60 and the outer shell 20. In the illustrative embodiment, the mounting flanges 48 of the mounting rings 40, 42 extend over, and are arranged concentrically with, the ends 130, 132, respectively, of the insulation sleeve 32. The mounting rings 40, 42 also define the amount that the outer shell 20 is spaced apart from the tips of the corrugations 66 of the metallic body 60.

As described above, the outer shell 20 is configured to prevent contact between environmental debris and the internal components, including the metallic body 60, of the exhaust coupler assembly 16. In the illustrative embodiment, the outer shell 20 extends a distance 140 between its ends 24, 26. The corrugations 66 of the metallic body 60 extend a distance 142 between the mounting rings 40, 42. The distance 142 is less than the distance 140 such that the outer shell 20 prevents debris from contacting the plurality of corrugations 66.

Figure 5:
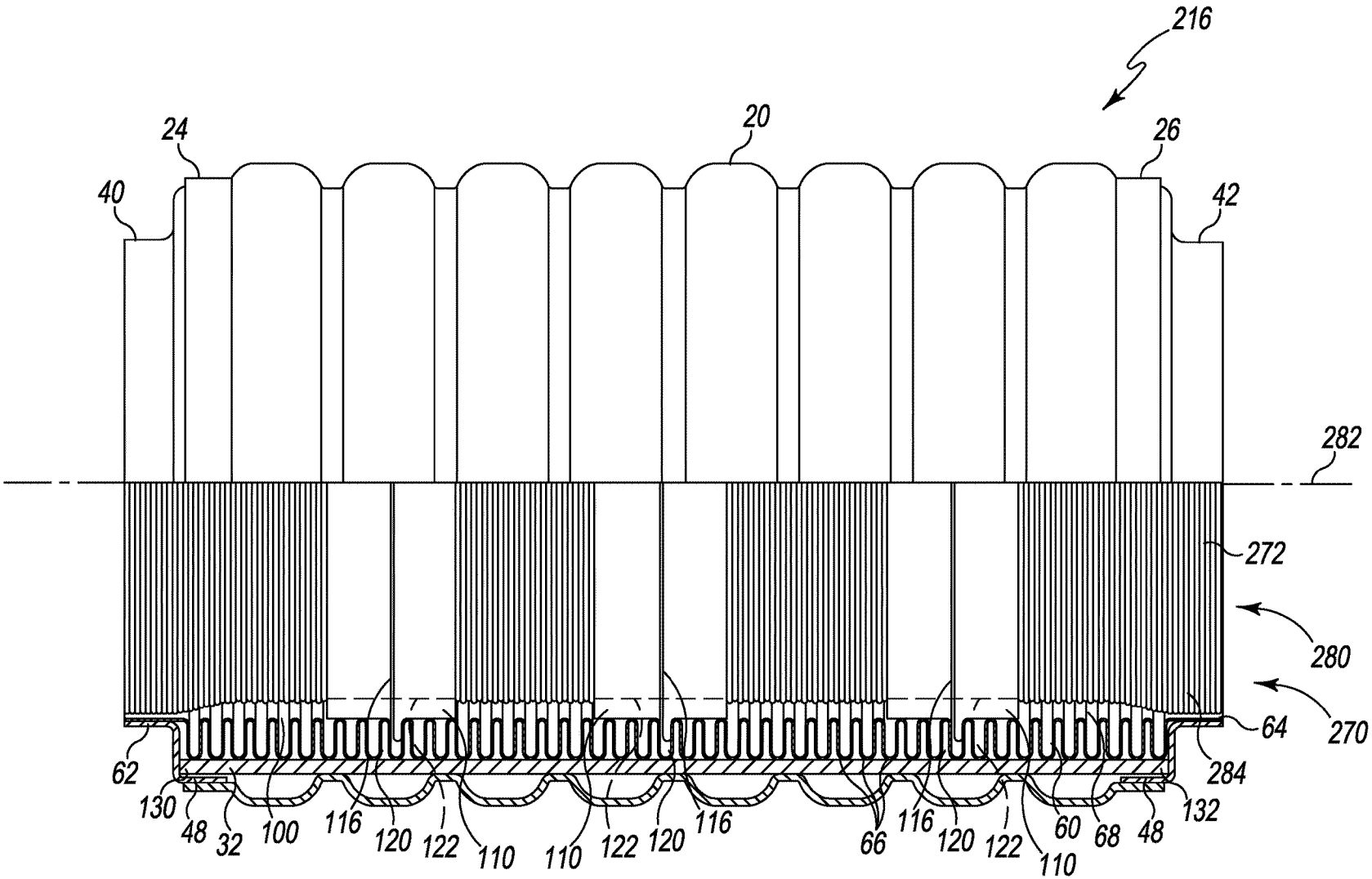
FIG. 5 is a partial cross-sectional elevation view of another embodiment of an exhaust coupler assembly for use in an exhaust system.

Referring now to FIG. 5, another embodiment of an exhaust coupler assembly 216 is shown. A number of the features of the coupler assembly 216 are similar to the features described above in regard to the coupler assembly 16. Such features are identified in the assembly 216 with the same reference numbers as were used to identify the features in the coupler assembly 16. The assembly 216 includes an outer shell 20 that is secured at each of its longitudinal ends 24, 26 to the mounting rings 40, 42, respectively. The outer shell 20 covers the internal components of the assembly 216 to prevent contact with environmental debris.

The assembly 216 includes a liner assembly 270 that includes a sleeve 272. Similar to the sleeve 72 described above in regard to the assembly 16, the sleeve 272 is formed of a spirally wound strip in which adjacent edges are interlocked. In illustrative embodiment, the sleeve 272 is positioned in the central sleeves 44 of the rings 40, 42.

The sleeve 272 also includes a cylindrical bore 280 that defines a section of the passageway 18 through which the exhaust gases flow. In illustrative embodiment, the sleeve 272 (and the other components of the assembly 216) are positioned along a longitudinal axis 282. The sleeve 272 is illustratively arranged concentrically with a corrugated metallic body 60. The sleeve 272 has a central section that includes an outer surface 284 that is spaced apart from the inner surface 100 of the metallic body 60.

As described above, the metallic body 60 extends from a longitudinal end 62 to an opposite longitudinal end 64. The metallic body 60 includes a plurality of corrugations 66 positioned between the ends 62, 64. The metallic body 60 also includes a central passageway 68 that extends through the ends 62, 64 of the body 60. The central passageway 68 is sized to receive the sleeve 272.

In the illustrative embodiment, the assembly 216 also includes a plurality of spacer rings 110 that are positioned along the longitudinal axis 282. As described above, each ring 110 includes an annular rib or tab 116 that is sized to be received in one of the slots 120 formed by the corrugations 66 in the inner surface 100 of the body 60. Each bushing 112 also has a central bore 122 that is sized to receive the sleeve 272, as shown in FIG. 5.

The assembly 216 also includes an insulation sleeve 32 that is wrapped around the corrugations 66 of the metallic body 60 and is positioned between the metallic body 60 and the outer shell 20. In the illustrative embodiment, the mounting flanges 48 of the mounting rings 40, 42 extend over, and are arranged concentrically with, the ends 130, 132, respectively, of the insulation sleeve 32. The mounting rings 40, 42 also define the amount that the outer shell 20 is spaced apart from the tips of the corrugations 66 of the metallic body 60.

Figure 6:
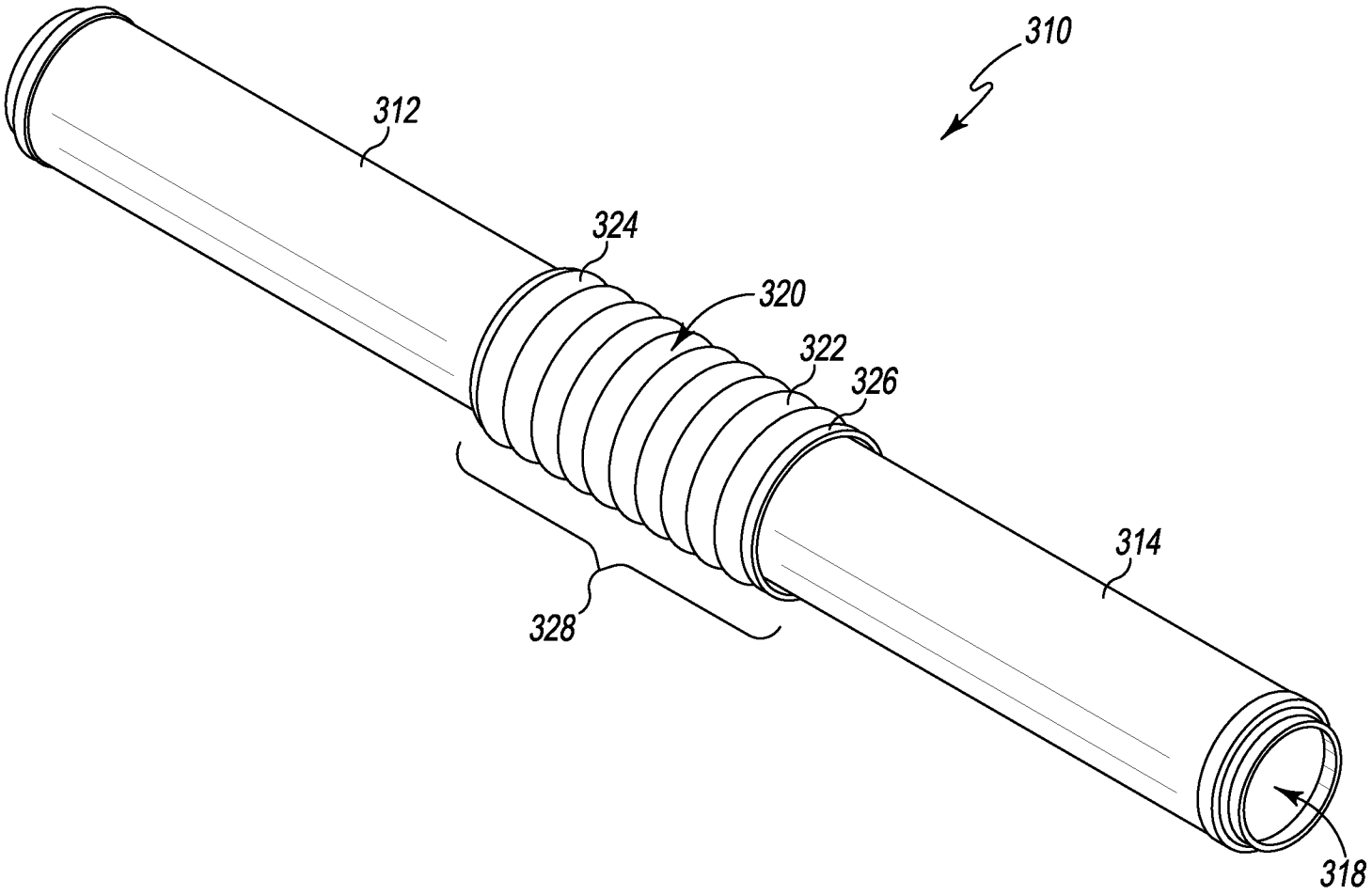
FIG. 6 is a plan view of another embodiment of an exhaust system.
Figure 7:
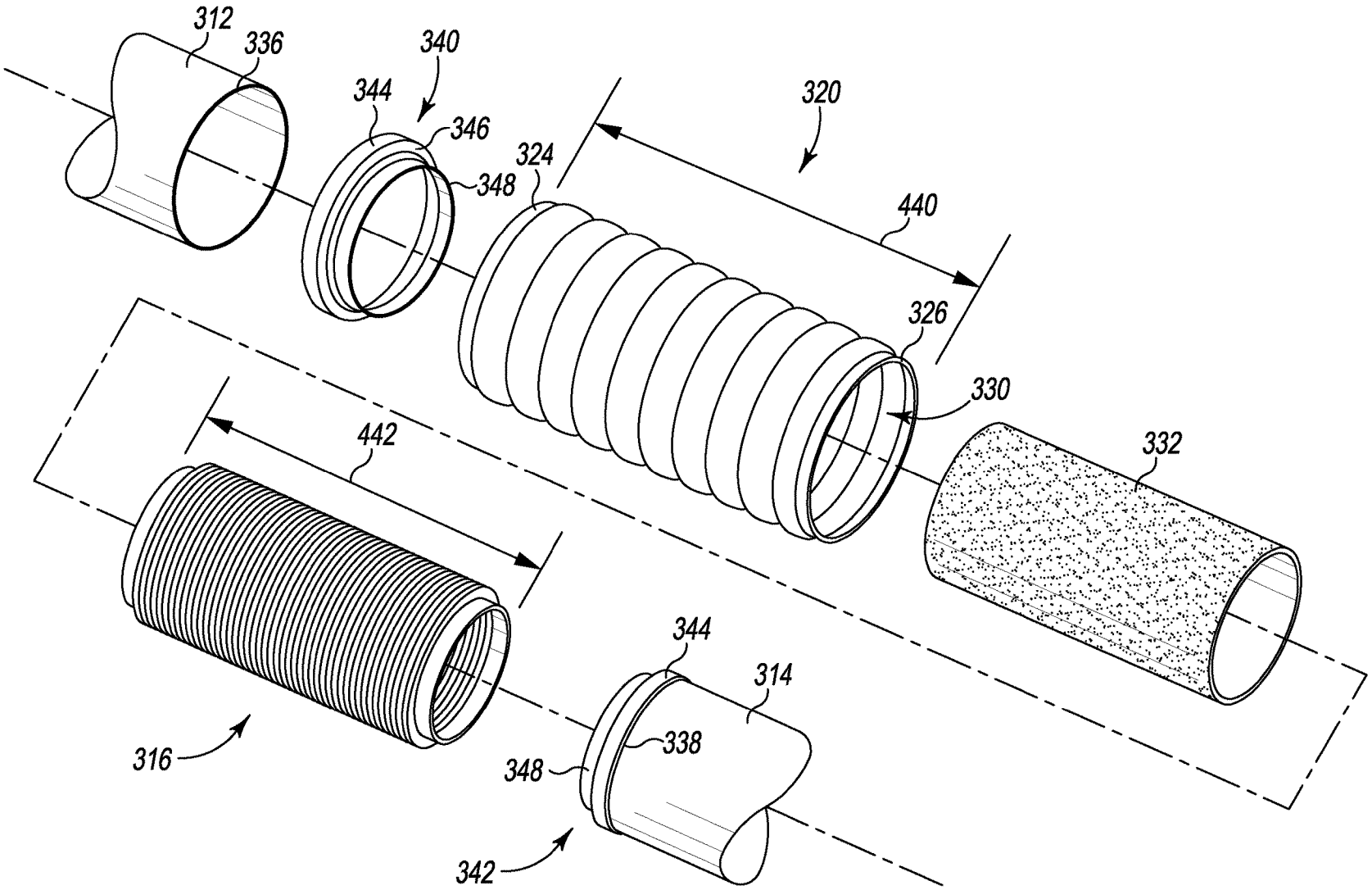
FIG. 7 is an exploded perspective view of the system of FIG. 6.
Figure 8:
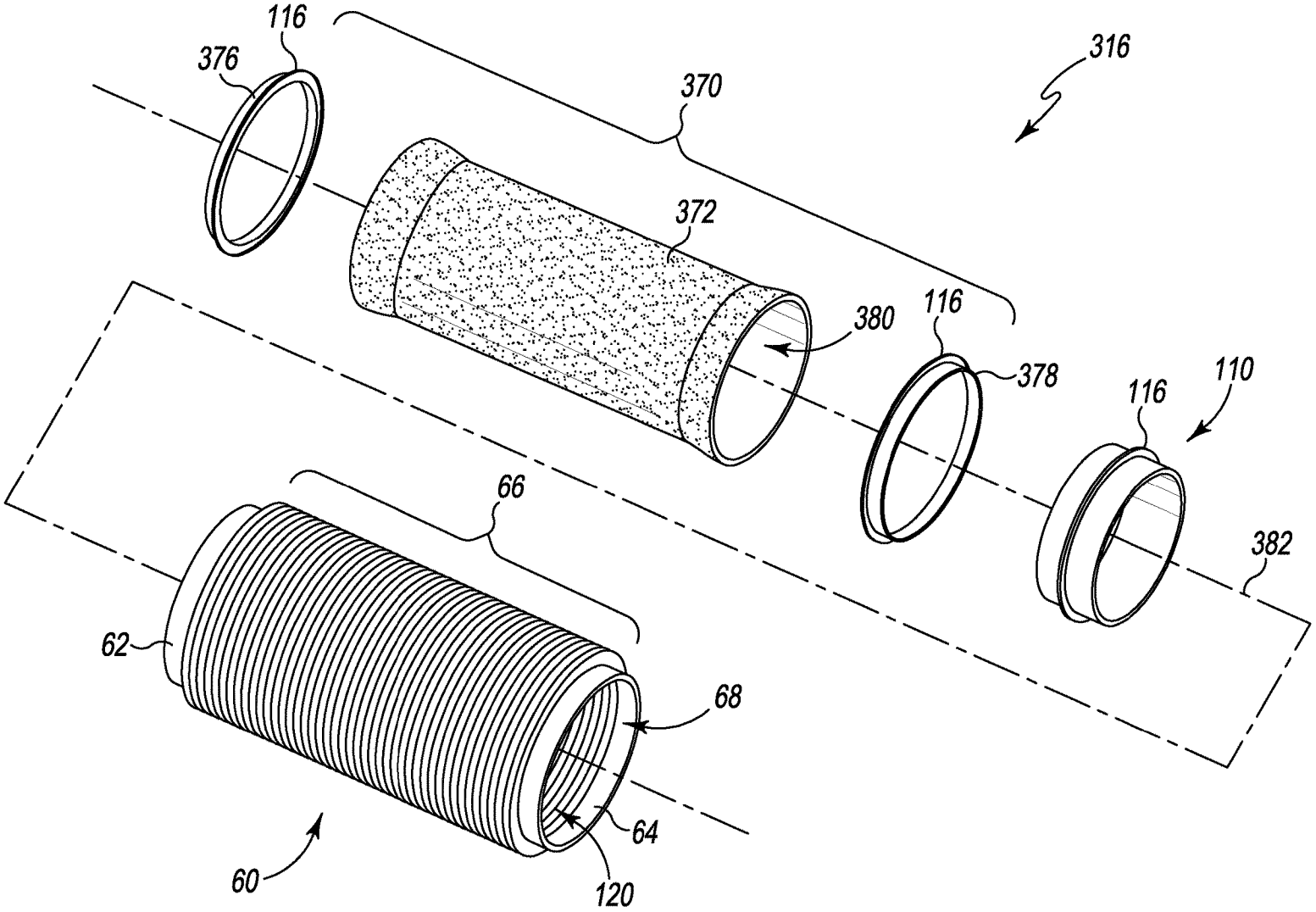
FIG. 8 is an exploded perspective view of an exhaust coupler assembly of the system of FIGS. 6-7.

Referring now to FIGS. 6-8, a portion of an exhaust system 310 for an automobile, truck, farm equipment, construction equipment, or other equipment is shown. The exhaust system 310 includes a pipe section 312 and a pipe section 314 that are connected by an exhaust coupler assembly 316 (see FIG. 7). The sections 312, 314 and the coupler assembly 316 cooperate to define a passageway 318 through which exhaust gases flow.

As shown in FIG. 6, the system 310 also includes an outer shell 320 that covers the coupler assembly 316 and the ends of the sections 312, 314 to prevent contact between environmental debris, such as, for example, seeds, sand, dried leaves, gravel, or other objects, and the internal components of the coupler assembly. In the illustrative embodiment, the shell 320 has a relatively low skin temperature (less than 300 degrees Fahrenheit) relative to the exhaust gas temperature, which, in some cases, may exceed 900 degrees Fahrenheit.

The shell 320 includes a substantially cylindrical body 322 that extends from a longitudinal end 324 to an opposite longitudinal end 326. The shell 320 includes a plurality of corrugations 328 defined in the outer surface of the body 322. In the illustrative embodiment, the corrugations 328 extend the length of the cylindrical body 322. In other embodiments, the shell 320 may include fewer corrugations positioned over a smaller portion of the cylindrical body. In still other embodiments, the corrugations may be larger or smaller than the corrugations 328 shown in FIG. 6.

As shown in FIG. 7, the shell 320 also includes a central passageway 330 that extends through the ends 324, 326 of the body 322. The central passageway 330 is sized to receive an insulation sleeve 332, the coupler assembly 316, and the ends 336, 338 of the pipe sections 312, 314, respectively. The insulation sleeve 332 is positioned between the shell 320 and the assembly 316. In the illustrative embodiment, the sleeve 332 is formed from silica fiber insulation. It should also be appreciated that in other embodiments the sleeve 332 may be omitted.

The system 310 also includes a pair of mounting rings 340, 342, which are secured at the ends 336, 338, respectively, of the pipe sections 312, 314. The mounting ring 340 includes a central sleeve 344 and an annular wall 346 extending outwardly from one end of the sleeve 344. The sleeve 344 is sized to be positioned over the end 336 of the pipe section 312. A mounting flange 348 extends away from the outer edge of the annular wall 346.

The mounting ring 342, like the mounting ring 340, includes a central sleeve 344, an annular wall 346 extending outwardly from one end of the sleeve 344, and a mounting flange 348 that extends away from the outer edge of the annular wall 346. As shown in FIG. 7, the central sleeve 344 of the ring 342 is positioned over the end 338 of the pipe section 314. Each of the rings 340, 342 is formed from a metallic material such as, for example, stainless steel. In the illustrative embodiment, a tension strap clamp (not shown) may be used with each of the rings 340, 342 to secure the rings 340, 342 to the outer shell 320. One example of the tension strap clamp is the Panduit Pan-Steel clamp, which is commercially available from Panduit Corporation.

Referring now to FIG. 8, the assembly 316 is shown in greater detail. The assembly 316, like the assemblies 16, 216, includes a metallic body 60 that extends from a longitudinal end 62 to an opposite longitudinal end 64. The metallic body 60 includes a plurality of corrugations 66 positioned between the ends 62, 64. The metallic body 60 also includes a central passageway 68 that extends through the ends 62, 64 of the body 60. The metallic body 60 may be formed of any suitable metallic material including, for example, stainless steel.

The assembly 316 also includes a liner assembly 370 that is arranged concentrically with the metallic body 60. Similar to the sleeves 72, 272 described above, the sleeve 372 is formed of a spirally wound strip in which adjacent edges are interlocked. In illustrative embodiment, the assembly 370 also includes a pair of support rings 376, 378 positioned at the longitudinal ends of the sleeve 372.

The sleeve 372 also includes a cylindrical bore 380 that defines a section of the passageway 18 through which the exhaust gases flow. In illustrative embodiment, the sleeve 372 (and the other components of the assembly 316 and the shell 320) are positioned along a longitudinal axis 382.

The assembly 316 also includes a spacer ring 110 that is positioned along the longitudinal axis 382. As described above, the ring 110 includes an annular rib or tab 116 that is sized to be received in one of the slots 120 formed by the corrugations 66 in the inner surface 100 of the body 60. Each of the support rings 376, 378 also includes an annular tab 116, and the support rings 376, 378 are spot welded to the liner sleeve 372 and the metallic body 60. It should be appreciated that in other embodiments each of support rings 376, 378 of the liner assembly 370 may act as a spacer ring.

As described above, the shell 320 is configured to prevent contact between environmental debris and the internal components, including the metallic body 60, of the exhaust coupler assembly 316. In the illustrative embodiment shown in FIG. 7, the shell 320 extends a distance 440 between its ends 324, 326. The assembly 316 extends a distance 442 between the ends 336, 338 of the pipe sections. The distance 442 is less than the distance 440 such that the shell 320 prevents debris from contacting the assembly 316.

Figure 9:
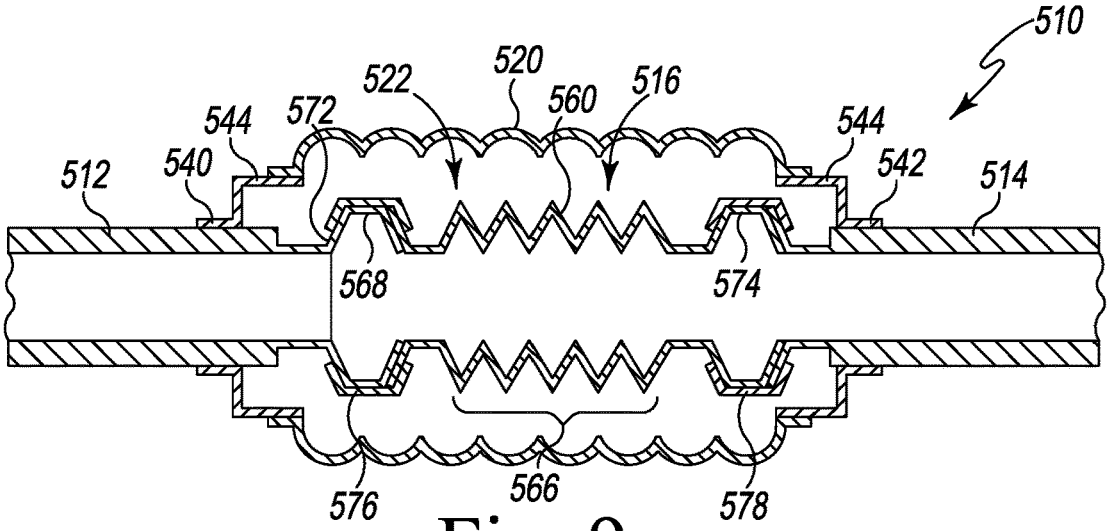
FIGS. 9-11 are cross-sectional elevation views of other embodiments of exhaust systems including silicone shells.
Figure 10:
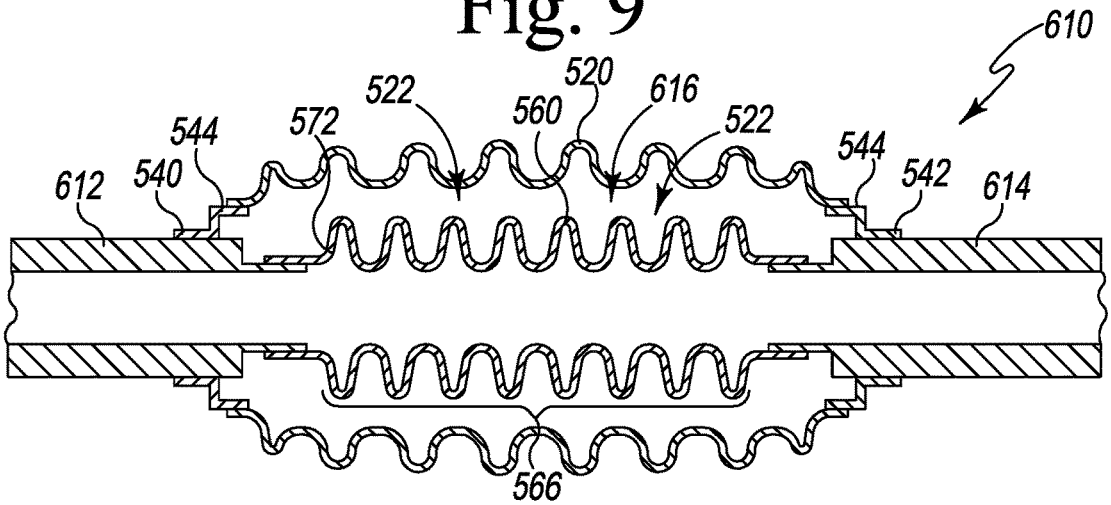
Figure 11:
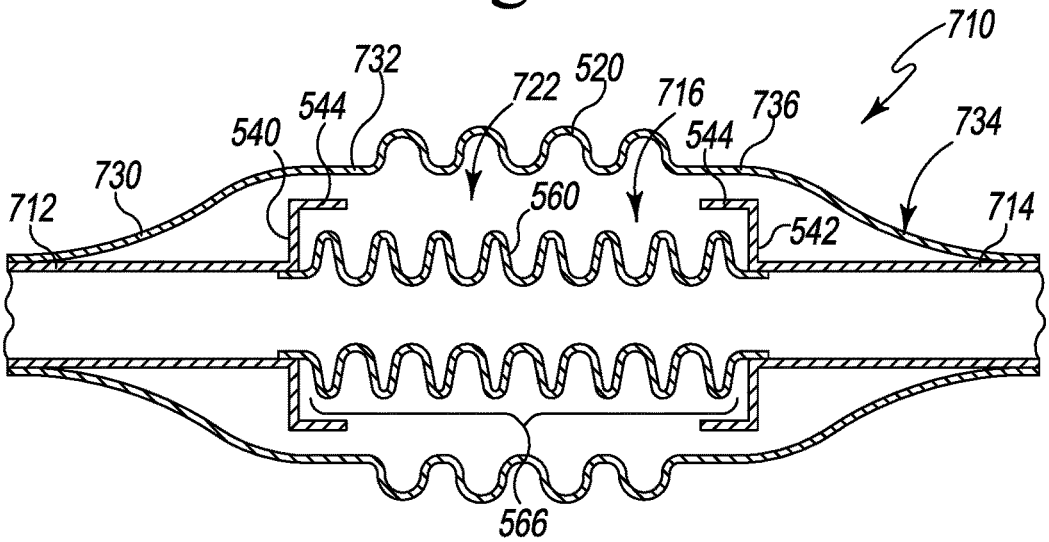

Referring now to FIGS. 9-11, other embodiments of exhaust systems including silicone shells are shown. As shown in FIG. 9, an exhaust system 510 includes a pair of pipe sections 512, 514 and an exhaust coupler assembly 516 that is positioned between the pipe sections. The system 510 also includes a non-metallic outer shell 520 that covers the coupler assembly 516 and defines a cavity or chamber 522 in which the coupler assembly 516 is positioned. Similar to the outer shells 20, 320 described above, the outer shell 520 is formed from silicone.

The coupler assembly 516 includes a metallic body 560 that has a plurality of corrugations 566, and a pair of end fittings 568, 570 configured to be secured to fittings 572, 574 extending from the pipe sections 512, 514, respectively. In the illustrative embodiments, the fittings 568, 572 are secured together via a clamp 576, and the fittings 570, 574 are secured together via a clamp 578. As shown in FIG. 9, the clamps 576, 578 and the fittings are covered by the shell 520 to prevent contact with environmental debris. Although not described in greater detail, it should be appreciated that the coupler assembly 516 may include any of the liner assemblies and/or an insulation sleeve similar to those described above in regard to FIGS. 1-7.

Similar to the embodiment of FIGS. 6-8, the shell 520 is secured to the pipe sections 512, 514 via mounting rings 540, 542, respectively. Each of the mounting rings 540, 542 includes a mounting flange 544 spaced apart from the pipe sections 512, 514, as shown in FIG. 9.

Referring now to FIG. 10, an exhaust system 610 includes a pair of pipe sections 612, 614 and an exhaust coupler assembly 616 that is positioned between the pipe sections. The system 610 also includes a shell 520 that covers the coupler assembly 616 and defines a cavity or chamber 522 in which the coupler assembly 616 is positioned.

The shell 520 is secured to the pipe sections 612, 614 via mounting rings 540, 542, respectively. Each of the mounting rings 540, 542 includes a mounting flange 544 spaced apart from the pipe sections 612, 614.

The coupler assembly 616 includes a metallic body 560 that has a plurality of corrugations 566, and a pair of end fittings 668, 670 configured to be mounted on pipe ends 672, 674 extending from the pipe sections 612, 614, respectively. In the illustrative embodiments, the coupler assembly 616 is secured to the pipe sections 612, 614 via interference fits between the ends 672, 674 and the end fittings 668, 670. Although not described in greater detail, it should be appreciated that the coupler assembly 616 may include any of the liner assemblies and/or an insulation sleeve similar to those described above in regard to FIGS. 1-7.

Referring now to FIG. 11, an exhaust system 710 includes a pair of pipe sections 712, 714 and an exhaust coupler assembly 616 that is positioned between the pipe sections. The system 710 also includes a shell 520 that covers the coupler assembly 716 and defines a cavity or chamber 522 in which the coupler assembly 716 is positioned.

The shell 520 is secured to the pipe sections 712, 714 via mounting rings 540, 542, respectively. Each of the mounting rings 540, 542 includes a mounting flange 544 spaced apart from the pipe sections 712, 714. As shown in FIG. 11, the system 710 further includes an encapsulation layer 730 that covers the mounting ring 540 and the end 732 of the shell 520. The system 710 also includes an encapsulation layer 734 that covers the mounting ring 542 and the end 736 of the shell 520. The layers 730, 734 cooperate with the shell 520 to define a chamber or cavity 722 that is protected from contact with environmental debris.

Figure 12:
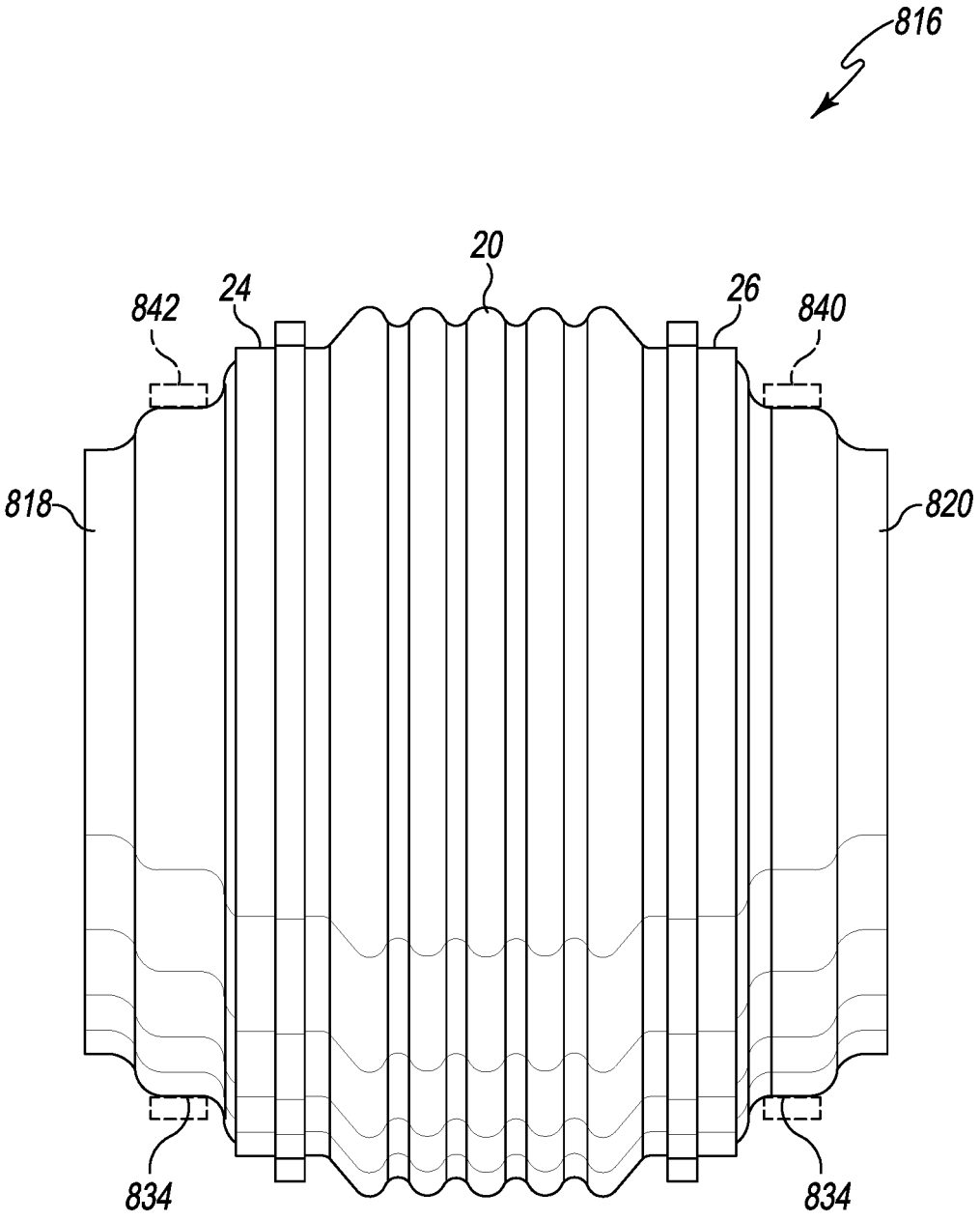
FIG. 12 is an elevation view of another embodiment of an exhaust coupler assembly for use in an exhaust system.
Figure 13:
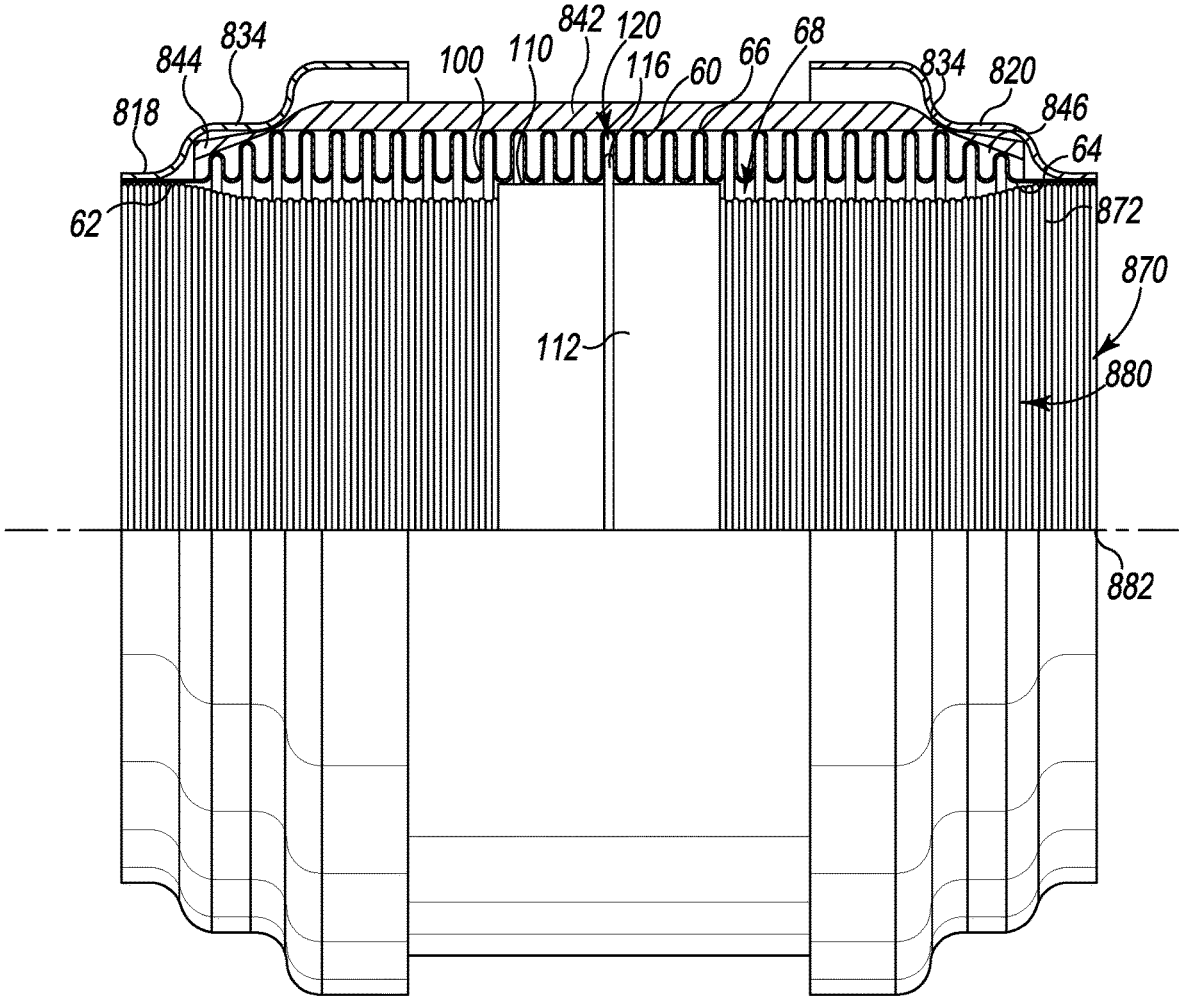
FIG. 13 is a partial cross-sectional elevation view of the exhaust coupler assembly of FIG. 12.
Figure 14:
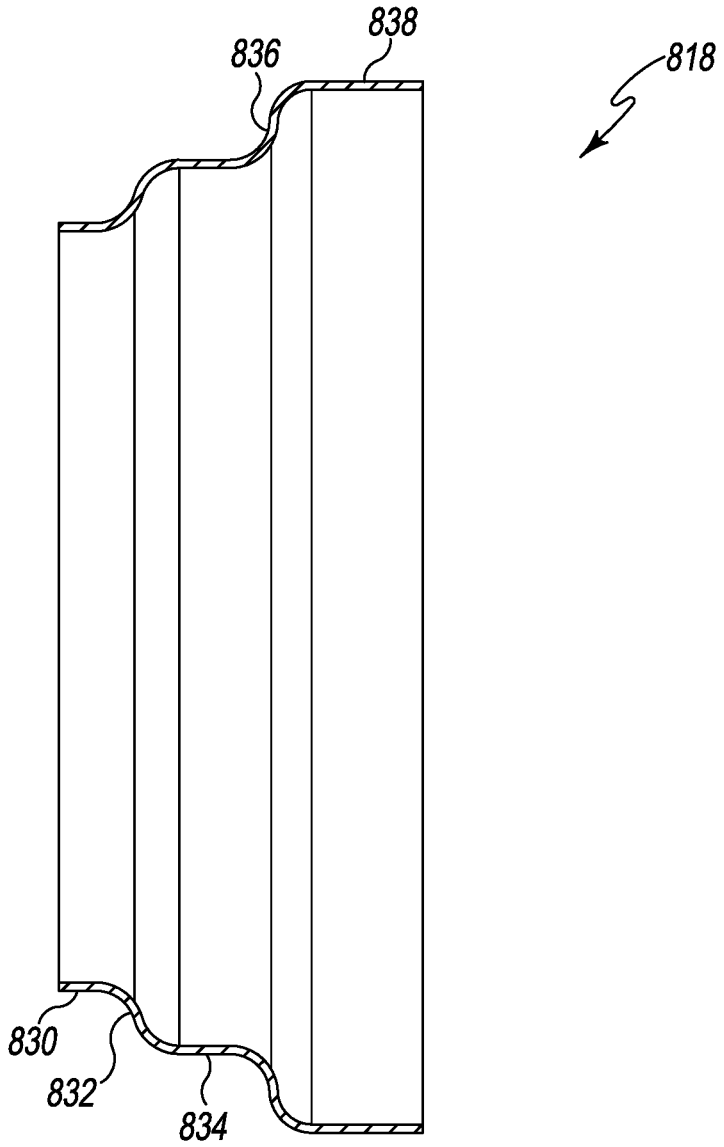
FIG. 14 is a cross-sectional elevation view of one of the end rings of the exhaust coupler assembly of FIGS. 12-13.

Referring now to FIGS. 12-14, another embodiment of an exhaust coupler assembly (hereinafter coupler assembly 816) is shown. A number of features of the coupler assembly 816 are similar to the features described above in regard to the coupler assembly 16. Such features are identified in the assembly 816 with the same reference numbers. As shown in FIG. 12, the assembly 816 includes an outer shell 20 that is secured at each of its longitudinal ends 24, 26 to mounting rings 818, 820, respectively. The mounting rings 818, 820 are described in greater detail below. In the assembly 816, as in the assemblies 16 and 216, the outer shell 20 covers the internal components of the assembly 816 to prevent contact with environmental debris.

As shown in FIG. 13, the assembly 216 includes a liner assembly 870 that includes a sleeve 872. Similar to the sleeve 72 described above in regard to the assembly 16, the sleeve 872 is formed of a spirally wound strip in which adjacent edges are interlocked. The sleeve 872 also includes a cylindrical bore 880 that defines a section of the passageway 18 through which the exhaust gases flow. In illustrative embodiment, the sleeve 872 (and the other components of the assembly 816) are positioned along a longitudinal axis 882. The sleeve 872 is illustratively arranged concentrically with a corrugated metallic body 60. The sleeve 872 has a central section that includes an outer surface 884 that is spaced apart from the inner surface 100 of the metallic body 60.

As described above, the metallic body 60 extends from a longitudinal end 62 to an opposite longitudinal end 64. The metallic body 60 includes a plurality of corrugations 66 positioned between the ends 62, 64. The metallic body 60 also includes a central passageway 68 that extends through the ends 62, 64 of the body 60. The central passageway 68 is sized to receive the sleeve 872.

In the illustrative embodiment, the assembly 816 also includes a spacer ring 110 that is positioned along the longitudinal axis 282. The ring 110 includes an annular rib or tab 116 that is sized to be received in one of the slots 120 formed by the corrugations 66 in the inner surface 100 of the body 60. The bushing 112 of the ring 110 also has a central bore that is sized to receive the sleeve 872, as shown in FIG. 13.

Referring now to FIG. 14, the mounting ring 818 includes a central sleeve 830 and an annular wall 832 extending outwardly from one end of the sleeve 830. An inner mounting flange 834 extends away from the outer edge of the annular wall 832. The mounting ring 818 includes another annular wall 836 that extends outwardly from the end of the inner mounting flange 834, and an outer mounting flange 838 extends away from the outer edge of the annular wall 836. In that way, the inner mounting flange 834 is positioned radially inward of the outer mounting flange 838.

In the illustrative embodiment, the configuration of the mounting ring 820 is identical to the configuration of the mounting ring 818, and each of the rings 818, 820 is formed from a metallic material such as, for example, stainless steel. In the illustrative embodiment, the rings 818, 820 are spot welded to a liner assembly 870 of the exhaust coupler assembly 816. As shown in FIG. 12, the ends 24, 26 of the shell 20 are positioned over the outer mounting flanges 838 of the rings 818, 820, respectively. Strap clamps may be positioned over the ends 24, 26 and the outer mounting flanges 838 to secure the shell 20 to the rings 818, 820. As with the other embodiments described above, other fasteners may be used to secure the ring to the shell. In still other embodiments, one of the corrugations (i.e., corrugation 54) of the outer shell 20 may be received in each groove to secure the shell to the mounting ring.

As shown in FIG. 12, the inner mounting flanges 834 are positioned to receive insulation layers or sleeves 840, 842 extending from or to the pipe sections of the exhaust system. It should be appreciated that the pipe sections themselves may already be covered by insulation layers. The sleeves 840, 842, which connect the pipe sections to the assembly 816 and cover the mounting rings 818, 820, cooperate with the assembly 816 to completely insulate the exhaust system. Strap clamps may be positioned over the sleeves 840, 842 and the inner mounting flanges 834 to secure the sleeves 840, 842 to the rings 818, 820, respectively. In the illustrative embodiment, the sleeves 840, 842 are positioned radially inward of the outer shell 20. It should be appreciated that in other embodiments other fasteners may be used to secure the sleeves to the assembly 816.

As shown in FIG. 13, the assembly 816 also includes an insulation sleeve 842 formed from silica fiber insulation. The insulation sleeve 842 extends from an end 844 that is positioned between the inner mounting flange 834 of the ring 818 and the longitudinal end 62 of the body 60 to another end 846 positioned between the inner mounting flange 834 of the other ring 820 and the longitudinal end 64 of the body 60. In that way, the ends of the sleeves 840, 842 overlap with the ends of the insulation sleeve 842 to completely insulate the exhaust system.

Each encapsulation layer of FIG. 11 is formed from silica fiber insulation. In other embodiments, the layer may be formed from other insulation materials such as, for example, aerogel, fiberglass, basalt, e-glass, or any other type of high temperature-rated insulation. It should also be appreciated that encapsulation layers may be added to any of the embodiments described above, including the embodiments shown in FIGS. 1-5 and 12-14.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A system comprising:

a metallic body including a first longitudinal end, a second longitudinal end, and a first plurality of corrugations between the first longitudinal end and the second longitudinal end, a first ring secured to the first longitudinal end of the metallic body, the first ring being configured to be coupled to a first pipe section of an exhaust system, a second ring secured to the second longitudinal end of the metallic body, the second ring being configured to be coupled to a second pipe section of the exhaust system, and a silicone shell spaced apart from, and arranged concentrically with, the metallic body, the silicone shell includes a second plurality of corrugations and extends a first distance between a first shell end and a second shell end, wherein the first plurality of corrugations extend a second distance along the metallic body, the second distance being less than the first distance such that the silicone shell prevents debris from contacting the first plurality of corrugations.

2. The system of claim 1, wherein the first shell end of the silicone shell is secured to the first ring.

3. The system of claim 2, wherein the second shell end of the silicone shell is secured to the second ring.

4. The system of claim 1, further comprising a first mounting flange secured to the first pipe section of the exhaust system, wherein the first shell end of the silicone shell is coupled to the first mounting flange.

5. The system of claim 4, further comprising a second mounting flange secured to the second pipe section of the exhaust system, wherein the second shell end of the silicone shell is coupled to the second mounting flange.

6. The system of claim 1, further comprising an insulation sleeve positioned between the metallic body and the silicone shell.

7. The system of claim 1, further comprising an inner sleeve positioned in a central passageway extending through the first longitudinal end and the second longitudinal end of the metallic body.

8. The system of claim 7, wherein the inner sleeve includes a first end positioned in the first ring and a second end positioned in the second ring.

9. The system of claim 7, wherein the inner sleeve is a first inner sleeve, and a second inner sleeve includes a central section that is spaced apart from, and arranged concentrically with, a central section of the first inner sleeve.

10. The system of claim 9, further comprising a plurality of mesh rings positioned between the first inner sleeve and the plurality of corrugations of the metallic body.

11. The system of claim 10, further comprising a number of spacer rings positioned between the first inner sleeve and the second inner sleeve.

12. The system of claim 9, wherein the second inner sleeve has a first end positioned in the first ring and a second end positioned in the second ring.

13. An exhaust coupler assembly, comprising:

an inner sleeve extending along a longitudinal axis, the inner sleeve including a first end configured to be coupled to a first pipe section of an exhaust system and a second end configured to be coupled to a second pipe section of the exhaust system, a metallic body extending along the longitudinal axis, the metallic body including a plurality of corrugations spaced apart from, and arranged concentrically with, the inner sleeve, a first ring positioned over the first end of the inner sleeve, the first ring including a first mounting flange spaced apart from, and arranged concentrically with, a first corrugation of the plurality of corrugations of the metallic body, a second ring positioned over the second end of the inner sleeve, the second ring including a second mounting flange spaced apart from, and arranged concentrically with, a second corrugation of the plurality of corrugations of the metallic body, and a non-metallic shell spaced apart from, and arranged concentrically with, the metallic body, the shell having a first shell end secured to the first mounting flange and a second shell end secured to the second mounting flange, wherein the non-metallic shell extends a first distance from the first shell end to the second shell end, and the plurality of corrugations extend a second distance along the metallic body, the second distance being less than the first distance such that the non-metallic shell prevents debris from contacting the plurality of corrugations.

14. The exhaust coupler assembly of claim 13, wherein the non-metallic shell includes a second plurality of corrugations between the first shell end and the second shell end.

15. The exhaust coupler assembly of claim 13, further comprising an insulation sleeve positioned between the metallic body and the non-metallic shell, the insulation sleeve having a first sleeve end arranged concentrically with the first mounting flange and having a second sleeve end arranged concentrically with the second mounting flange.

16. The exhaust coupler assembly of claim 15, wherein the inner sleeve is a first inner sleeve, and the exhaust coupler assembly further comprises a second inner sleeve positioned between, and arranged concentrically with, the plurality of corrugations of the metallic body and the first inner sleeve.

17. The exhaust coupler assembly of claim 16, further comprising a plurality of spacer rings positioned between the first inner sleeve, the second inner sleeve, and the plurality of corrugations of the metallic body.

* * * * *